US009411251B2

(12) United States Patent
Coggan et al.

(10) Patent No.: US 9,411,251 B2
(45) **Date of Patent: *Aug. 9, 2016**

(54) PHOTOCONDUCTOR CONTAINING A CHARGE TRANSPORT LAYER HAVING AN ARYLAMINE HOLE TRANSPORT MATERIAL

(71) Applicant: Xerox Corporation, Norwalk, CT (US)

(72) Inventors: Jennifer A. Coggan, Kitchener (CA); Matthew A. Heuft, Oakville (CA); Gregory M. McGuire, Oakville (CA); Adrien P. Cote, Mississauga (CA); Jin Wu, Pittsford, NY (US); Kenny Tuan Tran Dinh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 153 days.

This patent is subject to a terminal disclaimer.

(21) Appl. No.: 13/957,142

(22) Filed: Aug. 1, 2013

(65) Prior Publication Data

US 2015/0037715 A1 Feb. 5, 2015

(51) Int. Cl.

| | |
|---|---|
| ***G03G 5/05*** | (2006.01) |
| ***G03G 5/06*** | (2006.01) |
| ***G03G 5/147*** | (2006.01) |

(52) U.S. Cl.

CPC ..... *G03G 5/0614* (2013.01); *G03G 5/056* (2013.01); *G03G 5/0564* (2013.01); *G03G 5/0696* (2013.01); *G03G 5/14721* (2013.01); *G03G 5/14791* (2013.01); *G03G 5/14795* (2013.01)

(58) Field of Classification Search

CPC .... G03G 5/047; G03G 5/0564; G03G 5/0614

USPC ..... 430/59.6, 58.85

See application file for complete search history.

(56) References Cited

U.S. PATENT DOCUMENTS

| | | | | |
|---|---|---|---|---|
| 5,804,344 | A | 9/1998 | Mitsumori | |
| 5,853,906 | A | 12/1998 | Hsieh | |
| 7,177,572 | B2 | 2/2007 | DiRubio et al. | |
| 7,309,557 | B2 * | 12/2007 | Yoshizawa et al. | 430/58.8 |
| 8,372,566 | B1 | 2/2013 | Cote et al. | |
| 8,623,578 | B2 * | 1/2014 | Wu | G03G 5/0564 430/59.6 |
| 8,765,339 | B2 * | 7/2014 | Wu | G03G 5/0564 430/58.8 |
| 2012/0028177 | A1 * | 2/2012 | Cote et al. | 430/56 |
| 2012/0094223 | A1 * | 4/2012 | Kano et al. | 430/56 |
| 2013/0330665 | A1 * | 12/2013 | Wu et al. | 430/64 |
| 2014/0065533 | A1 * | 3/2014 | Wu | G03G 5/0564 430/58.8 |

OTHER PUBLICATIONS

Diamond, Arthur S & David Weiss (eds.) Handbook of Imaging Materials, 2nd ed.. New York: Marcel-Dekker, Inc. (Nov. 2001) pp. 401-403.*

Borsenberger, Paul M. et al. Organic Photoreceptors for Imaging Systems. New York: Marcel-Dekker, Inc. (1993) pp. 6-17.*

* cited by examiner

*Primary Examiner* — Christopher D Rodee

(74) *Attorney, Agent, or Firm* — Hoffman Warnick LLC

(57) ABSTRACT

Disclosed herein is a photoconductor including a substrate, a photogenerating layer and a charge transport layer. The charge transport layer includes a hole transport molecule of N4,N4'-bis(4-((E)-4,4-diphenylbuta-1,3-dien-1-yl)phenyl)-N4,N4'-di-p-tolyl-[1,1'-biphenyl]-4,4'-diamine and a binder. The weight percent of the charge transport layer includes N4,N4'-bis(4-((E)-4,4-diphenylbuta-1,3-dien-1-yl)phenyl)-N4,N4'-di-p-tolyl-[1,1'-biphenyl]-4,4'-diamine at from about 50 to about 70.

17 Claims, 4 Drawing Sheets

PHOTOCONDUCTOR CONTAINING A CHARGE TRANSPORT LAYER HAVING AN ARYLAMINE HOLE TRANSPORT MATERIAL

BACKGROUND

1. Field of Use

This disclosure is generally directed to layered imaging members, photoreceptors, photoconductors, and the like.

2. Background

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

There is a need to improve the functional performance of xerographic photoreceptors. For example, it is desirable to reduce the post-discharge voltage of a photoreceptor to a few volts and to minimize changes in its electrical characteristics during prolonged electrical cycling. There is also a requirement to extend the life of the photoreceptor to create a long-life photoreceptor. It is therefore desirable to create a photoreceptor that has good electrical characteristics as well as a long life.

SUMMARY

Disclosed herein is a photoconductor including a substrate, a photogenerating layer; a charge transport layer an overcoat layer in contact with and contiguous to the charge transport layer. The charge transport layer includes a hole transport molecule of N4,N4'-bis(4-((E)-4,4-diphenylbuta-1,3-dien-1-yl)phenyl)-N4,N4'-di-p-tolyl-[1,1'-biphenyl]-4,4'-diamine and a binder.

Disclosed herein is a photoconductor including a substrate, a photogenerating layer and a charge transport layer. The charge transport layer includes [N4,N4'-bis(4-((E)-4,4-diphenylbuta-1,3-dien-1-yl)phenyl)-N4,N4'-di-p-tolyl-[1,1'-biphenyl]-4,4'-diamine]dispersed in a binder selected from the group consisting of biphenyl type of polycarbonate copolymers, tetraaryl polycarbonate copolymers and biaryl polycarbonate copolymers. The N4,N4'-bis(4-((E)-4,4-diphenylbuta-1,3-dien-1-yl)phenyl)-N4,N4'-di-p-tolyl-[1,1'-biphenyl]-4,4'-diamine is at a weight percent of the charge transport layer of from about 50 to about 70.

Disclosed herein is a xerographic apparatus. The apparatus includes an imaging member including a substrate, a photogenerating layer and a charge transport layer. The charge transport layer includes [N4,N4'-bis(4-((E)-4,4-diphenylbuta-1,3-dien-1-yl)phenyl)-N4,N4'-di-p-tolyl-[1,1'-biphenyl]-4,4'-diamine]dispersed in a binder selected from the group consisting of biphenyl type of polycarbonate copolymers, tetraaryl polycarbonate copolymers and biaryl polycarbonate copolymers. The N4,N4'-bis(4-((E)-4,4-diphenylbuta-1,3-dien-1-yl)phenyl)-N4,N4'-di-p-tolyl-[1,1'-biphenyl]-4,4'-diamine is at a weight percent of the charge transport layer of from about 50 to about 70. The apparatus includes a charging unit to impart electrostatic charge on the imaging member. The apparatus includes an exposure unit to create an electrostatic latent image on the imaging member. The apparatus includes an image material delivery unit to create an image on the imaging member.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
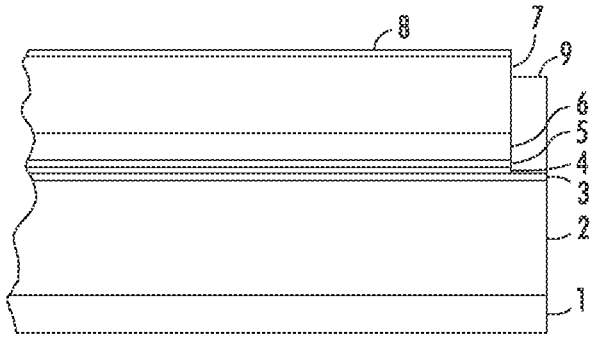
FIG. 1 is a cross-sectional view of an exemplary embodiment of a photoreceptor of the present disclosure.
Figure 2:
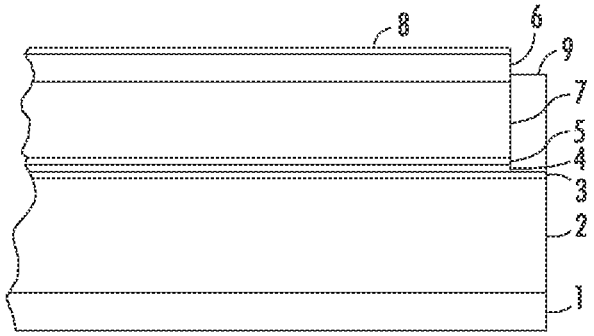
FIG. 2 is a cross-sectional view of an exemplary embodiment of a photoreceptor of the present disclosure.

Representative structures of an electrophotography imaging member (e.g., a photoreceptor) are shown in FIGS. 1-2. According to embodiments, there are provided with an anti-curl layer 1, a supporting substrate 2, an electrically conductive ground plane 3, a charge blocking layer 4, an adhesive layer 5, a charge generating layer 6, a charge transport layer 7, an overcoat layer 8, and a ground strip 9.

As seen in the FIGS. 1-2, in fabricating a photoreceptor, a charge generating material (CGM) and a charge transport material (CTM) may be deposited onto the substrate surface in a laminate type configuration where the CGM and CTM are in different layers (e.g., FIGS. 1 and 2). In embodiments, the photoreceptors may be prepared by applying over the electrically conductive layer the charge generation layer 6 and, optionally, a charge transport layer 7. In embodiments, the charge generation layer and, when present, the charge transport layer, may be applied in either order.

The charge transport layer 7 includes certain specific charge transport materials which are capable of supporting the injection of photogenerated holes or electrons from the charge generating layer 6 and allowing their transport through the charge transport layer 7 to selectively discharge the surface charge on the imaging member surface. The charge transport layer 7, in conjunction with the charge generating layer 6, should also be an insulator to the extent that an electrostatic charge placed on the charge transport layer 7 is not conducted in the absence of illumination. It should also exhibit negligible, if any, discharge when exposed to a wavelength of light useful in xerography, e.g., about 4000 Angstroms to about 9000 Angstroms. This ensures that when the photoreceptoror imaging member is exposed to radiation, most of the incident radiation is used in the charge generating layer beneath it to efficiently produce photogenerated charges.

There is a need to improve the functional performance of xerographic photoreceptors. For example, it is desirable to reduce the post-discharge voltage of a photoreceptor to a few volts and to minimize changes in its electrical characteristics during prolonged electrical cycling. There is also a need to extend the life of the photoreceptor to create a long-life photoreceptor. It is therefore desirable to create a photoreceptor that has good electrical characteristics as well as extending the life. The electrical performance of charge transport layers is generally improved by increasing the loading of charge transport materials. However, the loading of the charge transport material is dependent on the solubility of the charge transport materials in organic solvents and the polymer binder.

The present disclosure relates to embodiments of a photoconductor comprising a supporting substrate 2, a charge generating layer 6 and a charge transport layer 7. The charge transport layer 7 includes a charge transport material of N4,N4'-bis(4-((E)-4,4-diphenylbuta-1,3-dien-1-yl)phenyl)-N4,N4'-di-p-tolyl-[1,1'-biphenyl]-4,4'-diamine and a binder. The charge transport material N4,N4'-bis(4-((E)-4,4-diphenylbuta-1,3-dien-1-yl)phenyl)-N4,N4'-di-p-tolyl-[1,1'-biphenyl]-4,4'-diamine is from about 50 weight percent to about 70 weight percent of the charge transport layer 7. An optional protective overcoat layer 8 (OCL) can be included in the photoconductor.

The compound N4,N4'-bis(4-((E)-4,4-diphenylbuta-1,3-dien-1-yl)phenyl)-N4,N4'-di-p-tolyl-[1,1'-biphenyl]-4,4'-diamine (Structure 1) has been found useful as a high mobility charge transport molecule for photoreceptor applications due to its high discharge rate relative to conventional transport molecules such as N,N'-diphenyl-N,N-bis(3-methylphenyl)-1,1'-biphenyl-4,4'-diamine (m-TBD).

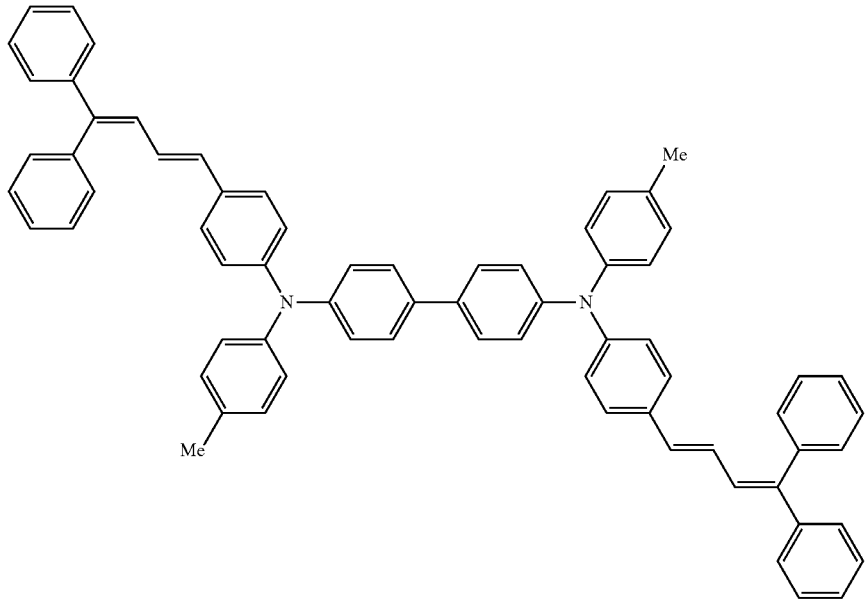

Structure 1: N4,N4'-bis(4-((E)-4,4-diphenylbuta-1,3-dien-1-yl)phenyl)-N4,N4'-di-p-tolyl-[1,1'-biphenyl]-4,4'-diamine An important characteristic of N4,N4'-bis(4-((E)-4,4-diphenylbuta-1,3-dien-1-yl)phenyl)-N4,N4'-di-p-tolyl-[1,1'-biphenyl]-4,4'-diamine is it is highly soluble in organic solvents and in a variety of polymer binders. This is important when making the formulation for coating as it will easily dissolve and a high loading can be used. It also means that the compound will not crystallize out of the CTL which is something that related aryl amine type compounds suffer from.

U.S. Pat. No. 5,804,344 (Sep. 8, 1998) by Mitsubishi Chemical Corporation discloses arylamine type compounds for use in an electophotographic photoreceptor; however, the advantageous properties of N4,N4'-bis(4-((E)-4,4-diphenylbuta-1,3-dien-1-yl)phenyl)-N4,N4'-di-p-tolyl-[1,1'-biphenyl]-4,4'-diamine are not described. Moreover, no examples are provided in U.S. Pat. No. 5,804,344 using N4,N4'-bis(4-((E)-4,4-diphenylbuta-1,3-dien-1-yl)phenyl)-N4,N4'-di-p-tolyl-[1,1'-biphenyl]-4,4'-diamine are provided that show the improved performance or the photoreceptor with structured organic film overcoat layers. In the Examples of U.S. Pat. No. 5,804,344, the loading of the arylamine type compounds in the charge transport layer was about 41 weight percent. A loading of greater than 50 weight percent was not possible with arylamine type compounds as the solubility in organic solvents was not high enough.

The synthesis of N4,N4'-bis(4-((E)-4,4-diphenylbuta-1,3-dien-1-yl)phenyl)-N4,N4'-di-p-tolyl-[1,1'-biphenyl]-4,4'-diamine is shown in Equation 1 below.

Equation 1.

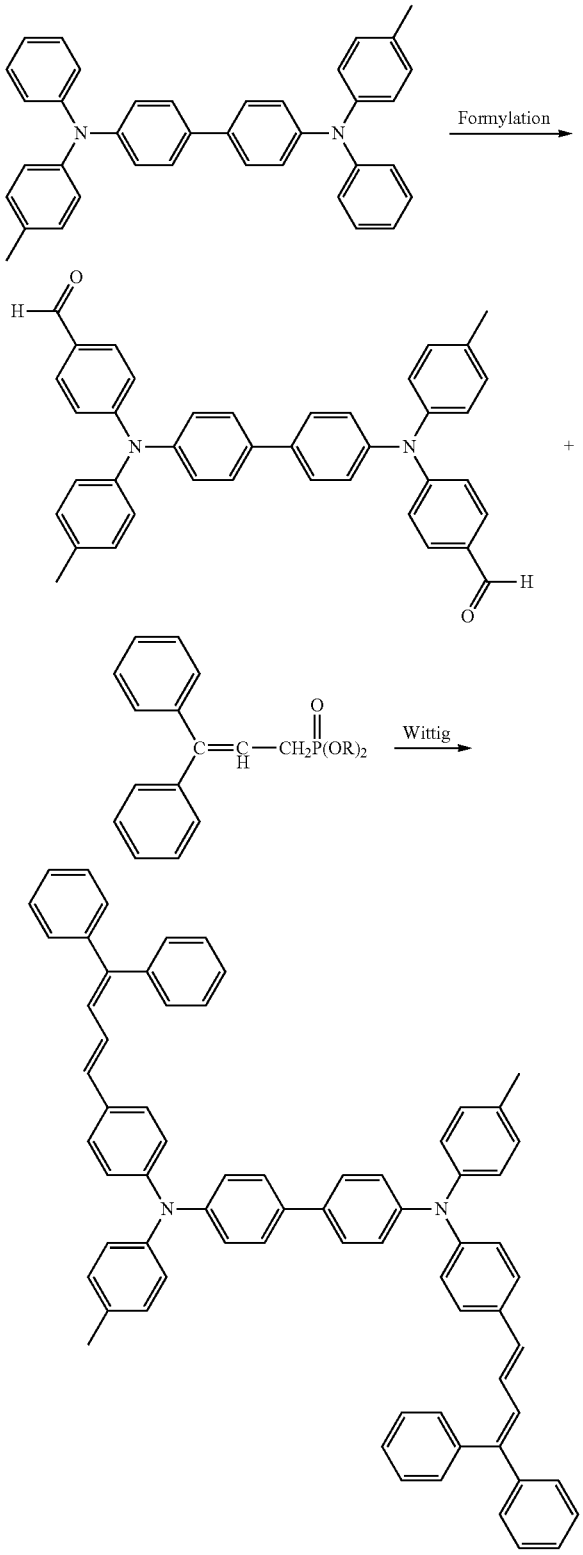

The following was the synthetic procedure used for the Witting reaction to prepare N4,N4'-bis(4-((E)-4,4-diphenylbuta-1,3-dien-1-yl)phenyl)-N4,N4'-di-p-tolyl-[1,1'-biphenyl]-4,4'-diamine:

p-TBD-dialdehyde (10 g) and 3,3-diphenylallylphosphite (20.19 g, 61 mmol) were placed into a 500 mL round bottom flask equipped with a stirbar, reflux condenser and under argon. To this 100 mL of N,N-dimethylformamide (DMF) was added and the mixture was stirred until everything dissolved. At room temperature, the 9.80 g of potassium t-butoxide (KOtBu) was added in 2 g portions to the reaction. The reaction was heated to 50° C. and stirred overnight. The reaction was monitored by HPLC.

Once the reaction was complete it was poured into 500 mL of methanol. The solid was collected and then dissolved in toluene which was then washed with water. The organic layer was collected, dried ($MgSO_4$) and concentrated in vacuum.

The product was purified by Kaufmann column using alumina (CG-20) and heptane as the solvent. When the heptane was cooled a bright yellow crystal was obtained. The crystals were collected by filtration and dried in a vacuum oven. The yield was 10 g (62%). The purity was greater than 99.5 percent determined by HPLC.

Examples of the binder materials suitable for the charge transport layer include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine-diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 percent to about 75 percent by weight of the charge transport material, and more specifically, from about 35 percent to about 50 percent of this material. The use of N4,N4'-bis(4-((E)-4,4-diphenylbuta-1,3-dien-1-yl)phenyl)-N4,N4'-di-p-tolyl-[1,1'-biphenyl]-4,4'-diamine allows greater than 50 percent by weight of charge transport material.

In embodiments, the binder for the charge transport layer can be selected from an biphenyl type of polycarbonate copolymers, tetraaryl polycarbonate copolymers or biaryl polycarbonate copolymers such as GE Lexan or PPG ester.

Biphenyl type of polycarbonate copolymers are shown below

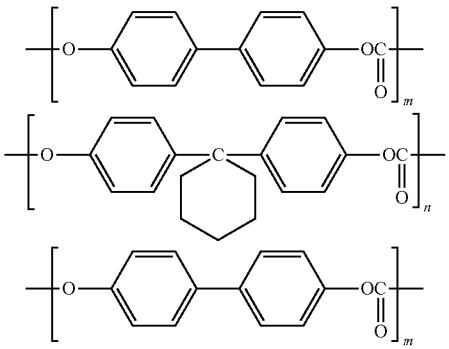

-continued

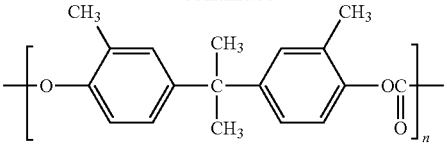

wherein the ratio or m/n is from about 40/60 to about 10/90 or from about 30/70 to about 15/85 or from about 25/75 to about 20/80.

Tetraaryl polycarbonate copolymers are shown below

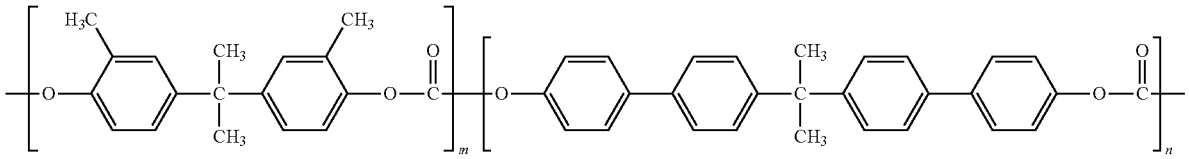

wherein the ratio or n/m is from about 40/60 to about 10/90 or from about 30/70 to about 15/85 or from about 25/75 to about 20/80 or wherein m is about 4 times greater than n. The viscosity average molecular weight is about 62,300.

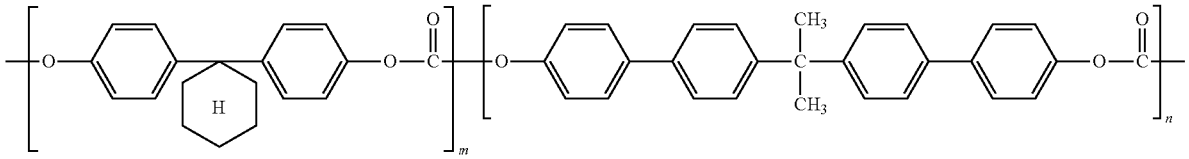

wherein the ratio or n/m is from about 40/60 to about 10/90 or from about 30/70 to about 15/85 or from about 25/75 to about 20/80 or wherein m is about 4 times greater than n. The viscosity average molecular weight is about 64,600.

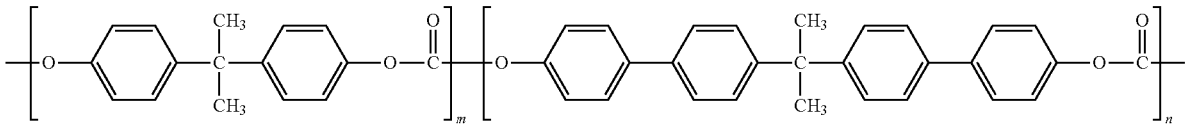

wherein the ratio or n/m is from about 40/60 to about 10/90 or from about 30/70 to about 15/85 or from about 25/75 to about 20/80 or wherein m is about 4 times greater than n. The viscosity average molecular weight is about 62,300.

Photoconductor Layer Examples

Anti Curl Layer

With continuing reference to FIGS. 1 and 2, an optional anti-curl layer 1, which comprises film-forming organic or inorganic polymers that are electrically insulating or slightly semi-conductive, may be provided. The anti-curl layer provides flatness and/or abrasion resistance.

Anti-curl layer 1 may be formed at the back side of the substrate 2, opposite the imaging layers. The anti-curl layer 1 may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Additives include organic and inorganic particles that may further improve the wear resistance and/or provide charge relaxation property. Organic particles include Teflon powder, carbon black, and graphite particles. Inorganic particles include insulating and semiconducting metal oxide particles such as silica, zinc oxide, tin oxide and the like. Another semiconducting additive is the oxidized oligomer salts as described in U.S. Pat. No. 5,853,906 incorporated herein in its entirety by reference. The oligomer salts are oxidized N,N,N',N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer 1 is typically from about 3 micrometers to about 35 micrometers, such as from about 10 micrometers to about 20 micrometers, or about 14 micrometers.

The anti-curl coating may be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer 1 may be accomplished simultaneously by web coating onto a multilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate may be opaque or substantially transparent and may comprise any additional suitable material(s) having given required mechanical properties, such as those described in U.S. Pat. Nos. 4,457,994; 4,871,634; 5,702,854; 5,976,744; and 7,384,717 the disclosures of which are incorporated herein by reference in their entireties.

The substrate 2 may comprise a layer of electrically non-conductive material or a layer of electrically conductive material, such as an inorganic or organic composition. If a non-conductive material is employed, it may be necessary to provide an electrically conductive ground plane over such non-conductive material. If a conductive material is used as the substrate, a separate ground plane layer may not be necessary.

The substrate may be flexible or rigid and may have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins may be used as electrically non-conducting materials, including, for example, polyesters, polycarbonates, polyamides, polyurethanes, and the like. Such a substrate may comprise a commercially available biaxially oriented polyester known as MYLAR™, available from E.I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E.I. duPont de Nemours & Co. The photoreceptor may also be coated on an insulating plastic drum, provided a conducting ground plane has previously been coated on its surface, as described above. Such substrates may either be seamed or seamless.

When a conductive substrate is employed, any suitable conductive material may be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum may be used, as well as the conducting metal drum made from a material such as aluminum.

The thickness of the substrate 2 depends on numerous factors, including the required mechanical performance and economic considerations. The thickness of the substrate is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The substrate for a flexible belt may be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the substrate to which a layer is to be applied may be cleaned to promote greater adhesion of such a layer. Cleaning may be effected, for example, by exposing the surface of the substrate layer to plasma discharge, ion bombardment, and the like. Other methods, such as solvent cleaning, may also be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, in embodiments, the photoreceptors prepared comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate may act as the conductive layer, although a conductive ground plane may also be provided.

If an electrically conductive ground plane is used, it is positioned over the substrate. Suitable materials for the electrically conductive ground plane include, for example, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium may be used.

The ground plane 3 may be applied by known coating techniques, such as solution coating, vapor deposition, and sputtering. A method of applying an electrically conductive ground plane is by vacuum deposition. Other suitable methods may also be used.

In embodiments, the thickness of the ground plane 3 may vary over a substantially wide range, depending on the optical transparency and flexibility desired for the electrophotoconductive member. For example, for a flexible photoresponsive imaging device, the thickness of the conductive layer may be between about 20 angstroms and about 750 angstroms; such as, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 may be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized.

If a blocking layer is employed, it may be positioned over the electrically conductive layer. The term "over," as used herein in connection with many different types of layers, should be understood as not being limited to instances wherein the layers are contiguous. Rather, the term "over" refers, for example, to the relative placement of the layers and encompasses the inclusion of unspecified intermediate layers.

The blocking layer 4 may include polymers such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387; 4,286,033; and 4,291,110 the disclosures of which are incorporated herein by reference in their entireties.

The blocking layer 4 may be continuous and may have a thickness ranging, for example, from about 0.01 to about 10 micrometers, such as from about 0.05 to about 5 micrometers.

The blocking layer 4 may be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as by vacuum, heating, and the like. Generally, a weight ratio of blocking layer material and solvent of between about 0.5:100 to about 30:100, such as about 5:100 to about 20:100, is satisfactory for spray and dip coating.

The charge blocking layer 4 can be formed by using a coating solution composed of the grain shaped particles, the needle shaped particles, the binder resin and an organic solvent.

The organic solvent may be a mixture of an azeotropic mixture of $C_{1-3}$ lower alcohol and another organic solvent selected from the group consisting of dichloromethane, chloroform, 1,2-dichloroethane, 1,2-dichloropropane, toluene and tetrahydrofuran. The azeotropic mixture mentioned above is a mixture solution in which a composition of the liquid phase and a composition of the vapor phase are coincided with each other at a certain pressure to give a mixture having a constant boiling point. For example, a mixture consisting of 35 parts by weight of methanol and 65 parts by weight of 1,2-dichloroethane is an azeotropic solution. The presence of an azeotropic composition leads to uniform evaporation, thereby forming a uniform charge blocking layer without coating defects and improving storage stability of the charge blocking coating solution.

The binder resin contained in the blocking layer 4 may be formed of the same materials as that of the blocking layer formed as a single resin layer. Among them, polyamide resin may be used because it satisfies various conditions required of the binder resin such as (i) polyamide resin is neither dissolved nor swollen in a solution used for forming the imaging layer on the blocking layer, and (ii) polyamide resin has an excellent adhesiveness with a conductive support as well as flexibility. In the polyamide resin, alcohol soluble nylon resin may be used, for example, copolymer nylon polymerized with 6-nylon, 6,6-nylon, 610-nylon, 11-nylon, 12-nylon and the like; and nylon which is chemically denatured such as N-alkoxy methyl denatured nylon and N-alkoxy ethyl denatured nylon. Another type of binder resin that may be used is a phenolic resin or polyvinyl butyral resin.

The charge blocking layer 4 is formed by dispersing the binder resin, the grain shaped particles, and the needle shaped particles in the solvent to form a coating solution for the blocking layer; coating the conductive support with the coating solution and drying it. The solvent is selected for improving dispersion in the solvent and for preventing the coating solution from gelation with the elapse of time. Further, the azeotropic solvent may be used for preventing the composition of the coating solution from being changed as time passes, whereby storage stability of the coating solution may be improved and the coating solution may be reproduced.

The phrase "n-type" refers, for example, to materials which predominately transport electrons. Typical n-type materials include dibromoanthanthrone, benzimidazole perylene, zinc oxide, titanium oxide, azo compounds such as chlorodiane blue and bisazo pigments, substituted 2,4-dibromotriazines, polynuclear aromatic quinones, zinc sulfide, and the like.

The phrase "p-type" refers, for example, to materials which transport holes. Typical p-type organic pigments include, for example, metal-free phthalocyanine, titanyl phthalocyanine, gallium phthalocyanine, hydroxy gallium phthalocyanine, chlorogallium phthalocyanine, copper phthalocyanine, and the like.

The Adhesive Layer

An intermediate layer 5 between the blocking layer 4 and the charge generating 6 layer may, if desired, be provided to promote adhesion. However, in embodiments, a dip coated aluminum drum may be utilized without an adhesive layer.

Additionally, adhesive layers may be provided, if necessary, between any of the layers in the photoreceptors to ensure adhesion of any adjacent layers. Alternatively, or in addition, adhesive material may be incorporated into one or both of the respective layers to be adhered. Such optional adhesive layers may have thicknesses of about 0.001 micrometer to about 0.2 micrometer. Such an adhesive layer may be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E.I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, such as about 70,000, and a $M_n$ of about 35,000.

The Imaging Layer(s)

The imaging layer refers to a layer or layers containing charge generating material, charge transport material, or both the charge generating material and the charge transport material.

Either a n-type or a p-type charge generating material may be employed in the present photoreceptor.

Charge Generation Layer

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, chlorogallium phthalocyanine, titanyl phthalocyanine and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. In embodiments, alloys of selenium may be used and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent may be for example cyclohexanone, methyl ethyl ketone, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the weight of the composition including a solvent. The amount of photoconductive particles (i.e., the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Because the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. The average photoconductive particle size may be less than about 0.4 micrometer. In embodiments, the photoconductive particle size is also less than the thickness of the dried photoconductive coating in which it is dispersed.

In a charge generating layer 6, the weight ratio of the charge generating material ("CGM") to the binder ranges from 30 (CGM):70 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. In embodiments, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges may be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer, a non-polymeric material, or a SOF, which may be a composite and/or capped SOF, capable of supporting the injection of photoexcited holes or transporting electrons from the photoconductive material and allowing the transport of these holes or electrons through the organic layer to selectively dissipate a surface charge.

Charge Transport Layer

Additional charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methylpyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, see U.S. Pat. No. 4,921,769 the disclosure of which is incorporated herein by reference in its entirety. Other hole transporting materials include arylamines described in U.S. Pat. No. 4,265,990 the disclosure of which is incorporated herein by reference in its entirety, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules may be selected, reference for example U.S. Pat. Nos. 4,921,773 and 4,464,450 the disclosures of which are incorporated herein by reference in their entireties.

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. The solids content is between about 2 percent by weight and 30 percent by weight based on the total weight of the dispersion. The expression "solids" refers, for example, to the charge transport particles and binder components of the charge transport coating dispersion. These solids concentrations are useful in dip coating, roll, spray coating, and the like. Generally, a more concentrated coating dispersion may be used for roll coating. Drying of the deposited coating may be effected by any suitable conventional technique such as oven drying, infra-red radiation drying, air drying and the like. Generally, the thickness of the transport layer is between about 5 micrometers to about 100 micrometers, but thicknesses outside these ranges can also be used. In general, the ratio of the thickness of the charge transport layer to the charge generating layer is maintained, for example, from about 2:1 to 200:1 and in some instances as great as about 400:1.

Overcoat Layer

Embodiments in accordance with the present disclosure can, optionally, further include an overcoat layer or layers 8, which, if employed, are positioned over the charge generation layer or over the charge transport layer.

In embodiments, the overcoat layer 8 may have a thickness ranging from about 1 micrometer to about 25 micrometers or from about 1 micrometer to about 10 micrometers, or in a specific embodiment, about 3 micrometers to about 10 micrometers. These overcoat layers typically comprise a charge transport component and an optional organic polymer or inorganic polymer. These overcoat layers may include thermoplastic organic polymers or cross-linked polymers such as thermosetting resins, UV or e-beam cured resins, and the likes. In embodiments the overcoat layer can include a polyethylene-block-polyethylene glycol copolymer and a melamine resin.

The overcoat layers may further include a particulate additive such as metal oxides including aluminum oxide and silica, or low surface energy polytetrafluoroethylene (PTFE), and combinations thereof. Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with the polymer resin to form a cured composition.

In embodiments, the overcoat 8 may comprise structured organic films (SOFs) that are electrically insulating or slightly semi-conductive. Such overcoat includes a structured organic film forming reaction mixture containing a plurality of molecular building blocks that optionally contain charge transport segments as described in U.S. Pat. No. 8,372,566 incorporated by reference in its entirety.

Additives may be present in the overcoating layer in the range of about 0.5 to about 40 weight percent of the overcoating layer. In embodiments, additives include organic and inorganic particles which can further improve the wear resistance and/or provide charge relaxation property. In embodiments, organic particles include Teflon powder, carbon black, and graphite particles. In embodiments, inorganic particles include insulating and semiconducting metal oxide particles such as silica, zinc oxide, tin oxide and the like. Another semiconducting additive is the oxidized oligomer salts as described in U.S. Pat. No. 5,853,906 the disclosure of which is incorporated herein by reference in its entirety. In embodiments, oligomer salts are oxidized N,N,N',N'-tetra-p-tolyl-4,4'-biphenyldiamine salt.

The Ground Strip

The ground strip 9 may comprise a film-forming binder and electrically conductive particles. Cellulose may be used to disperse the conductive particles. Any suitable electrically conductive particles may be used in the electrically conductive ground strip layer 8. The ground strip 8 may, for example, comprise materials that include those enumerated in U.S. Pat. No. 4,664,995 the disclosure of which is incorporated herein by reference in its entirety. Typical electrically conductive particles include, for example, carbon black, graphite, copper, silver, gold, nickel, tantalum, chromium, zirconium, vanadium, niobium, indium tin oxide, and the like.

The electrically conductive particles may have any suitable shape. Typical shapes include irregular, granular, spherical, elliptical, cubic, flake, filament, and the like. In embodiments, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers, such as from about 14 micrometers to about 27 micrometers.

The contact charging device may have a roller-shaped contact charging member. The contact charging member may be arranged so that it comes into contact with a surface of the photoreceptor, and a voltage is applied, thereby being able to give a specified potential to the surface of the photoreceptor. In embodiments, a contact charging member may be formed from a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber.

The resistance of the contact-charging member of embodiments may in any desired range, such as from about 100 to about $10^{14}$ Ω-cm, or from about $10^{2}$ to about $10^{12}$ Ω-cm. When a voltage is applied to this contact-charging member, either a DC voltage or an AC voltage may be used as the applied voltage. Further, a superimposed voltage of a DC voltage and an AC voltage may also be used.

In an exemplary apparatus, the contact-charging member may be in the shape of a roller. However, such a contact-charging member may also be in the shape of a blade, a belt, a brush or the like.

In embodiments an optical device that can perform desired imagewise exposure to a surface of the electrophotographic photoreceptor with a light source such as a semiconductor laser, an LED (light emitting diode) or a liquid crystal shutter, may be used as the exposure device.

In embodiments, a known developing device using a normal or reversal developing agent of a one-component system, a two-component system or the like may be used in embodiments as the developing device. There is no particular limitation on image forming material (such as a toner, ink or the like, liquid or solid) that may be used in embodiments of the disclosure.

Contact type transfer charging devices using a belt, a roller, a film, a rubber blade or the like, or a scorotron transfer charger or a scorotron transfer charger utilizing corona discharge may be employed as the transfer device, in various embodiments. In embodiments, the charging unit may be a biased charge roll, such as the biased charge rolls described in U.S. Pat. No. 7,177,572 entitled "A Biased Charge Roller with Embedded Electrodes with Post-Nip Breakdown to Enable Improved Charge Uniformity," the total disclosure of which is hereby incorporated by reference in its entirety.

Further, in embodiments, the cleaning device may be a device for removing a remaining image forming material, such as a toner or ink (liquid or solid), adhered to the surface of the electrophotographic photoreceptor after a transfer step, and the electrophotographic photoreceptor repeatedly subjected to the above-mentioned image formation process may be cleaned thereby. In embodiments, the cleaning device may be a cleaning blade, a cleaning brush, a cleaning roll or the like. Materials for the cleaning blade include SOFs or urethane rubber, neoprene rubber and silicone rubber While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Control Device

An imaging member incorporating m-TBD was prepared in accordance with the following procedure. A metallized mylar substrate was provided and a HOGaPc/poly(bisphenol-Z carbonate) photogenerating layer was machine coated over the substrate. A charge transport layer was prepared by introducing into an amber glass bottle 50 weight percent of m-TBD, and 50 weight percent of FPC-0170 Polymer. The resulting mixture was then dissolved in methylene chloride to form a solution containing 15 percent by weight solids. This solution was applied on the photogenerating layer to form a layer coating that upon drying (120° C. for 1 minute) that had a thickness of about 30 microns.

Example 2

An imaging member incorporating N4,N4'-bis(4-((E)-4,4-diphenylbuta-1,3-dien-1-yl)phenyl)-N4,N4'-di-p-tolyl-[1,1'-biphenyl]-4,4'-diamine was prepared in accordance with the following procedure. A metallized mylar substrate was provided and a HOGaPc/poly(bisphenol-Z carbonate) photogenerating layer was machine coated over the substrate. A charge transport layer was prepared by introducing into an amber glass bottle 50 weight percent of N4,N4'-bis(4-((E)-4,4-diphenylbuta-1,3-dien-1-yl)phenyl)-N4,N4'-di-p-tolyl-[1,1'-biphenyl]-4,4'-diamine, and 50 weight percent of FPC-0170 Polymer. The resulting mixture was then dissolved in methylene chloride to form a solution containing 15 percent by weight solids. This solution was applied on the photogenerating layer to form a layer coating that upon drying (120° C. for 1 minute) had a thickness of about 30 microns.

Example 3

An imaging member incorporating N4,N4'-bis(4-((E)-4,4-diphenylbuta-1,3-dien-1-yl)phenyl)-N4,N4'-di-p-tolyl-[1,1'-biphenyl]-4,4'-diamine was prepared in accordance with the following procedure. A metallized mylar substrate was provided and a HOGaPc/poly(bisphenol-Z carbonate) photogenerating layer was machine coated over the substrate. A charge transport layer was prepared by introducing into an amber glass bottle 40 weight percent of N4,N4'-bis(4-((E)-4,4-diphenylbuta-1,3-dien-1-yl)phenyl)-N4,N4'-di-p-tolyl-[1,1'-biphenyl]-4,4'-diamine, and 60 weight percent of PCZ-400 Polymer. The resulting mixture was then dissolved in Toluene to form a solution containing 22 percent by weight solids. This solution was applied on the photogenerating layer to form a layer coating that upon drying (100° C. for 40 minutes) had a thickness of about 30 microns.

An evaluation of the control device and examples 1 and 2 was conducted. Shown in Table 1, Example 1 and 2 have substantially lower voltages at V(1) and V(10).

TABLE 1

| P/R Sample: | | Control Device | Example 2 | Example 3 | Units |
|---|---|---|---|---|---|
| fitted parameters (ESV3) | Vo | 493 | 466 | 499 | V |
| | Vr | 45 | 10 | 17 | V |
| | Vc | 123 | 80 | 83 | V |
| | S | 345 | 312 | 368 | V * cm^2/erg |
| | V(1) | 208 | 178 | 163 | erg/cm^2 |
| | V(10) | 50 | 12 | 20 | erg/cm^3 |
| ESV5(avg) | | 29 | 3 | 12 | V |
| ESV1(avg) | | 542 | 535 | 544 | V |
| ESV2(avg) | | 515 | 502 | 516 | V |
| DD(ESV1-2) | | 27 | 34 | 28 | V |

Figure 3:
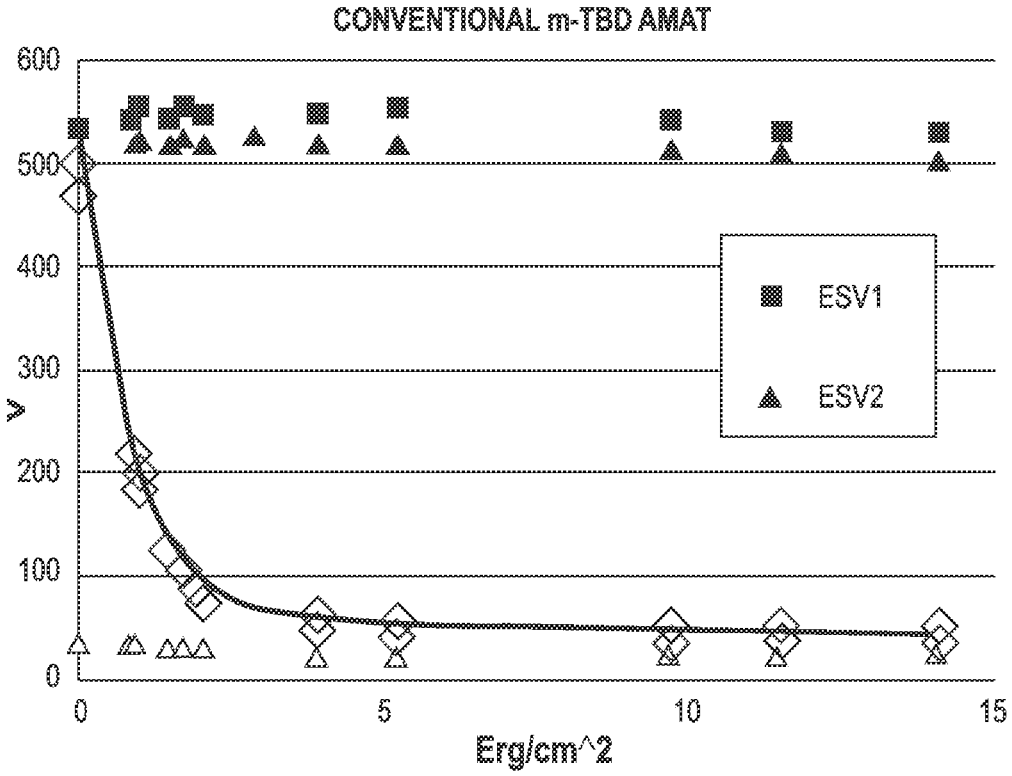
FIG. 3 is a photo-induced discharge curve (PIDC) of a control example.
Figure 4:
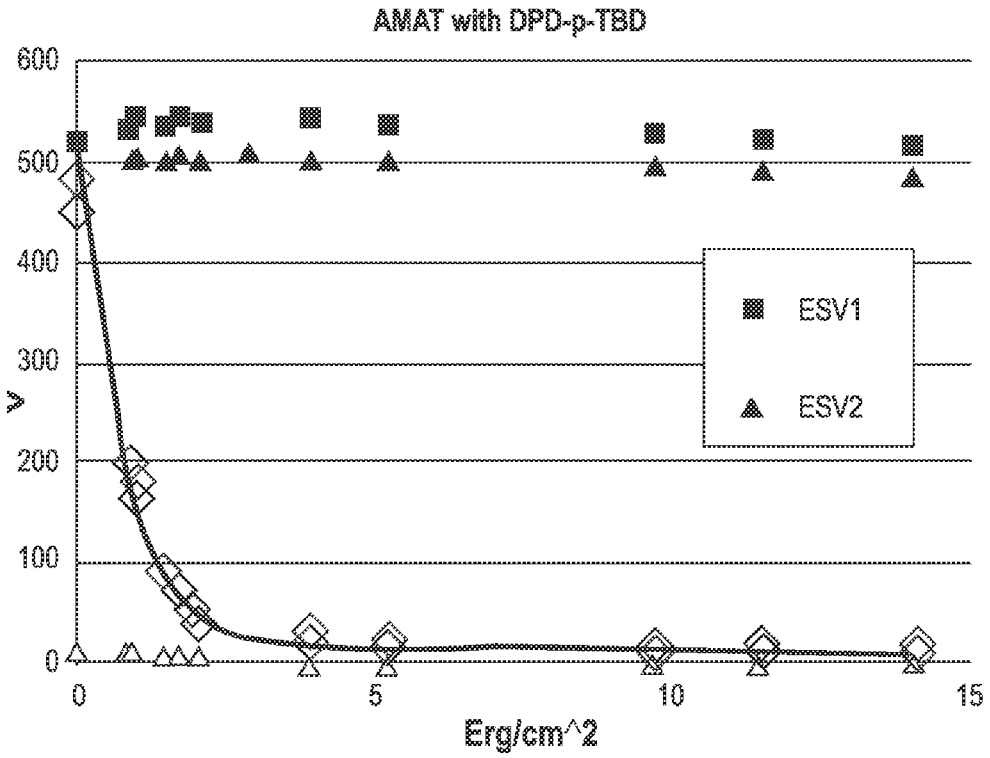
FIG. 4 is a PIDC of an example of an embodiment of a photoreceptor containing N4,N4'-bis(4-((E)-4,4-diphenylbuta-1,3-dien-1-yl)phenyl)-N4,N4'-di-p-tolyl-[1,1'-biphenyl]-4,4'-diamine.
Figure 5:
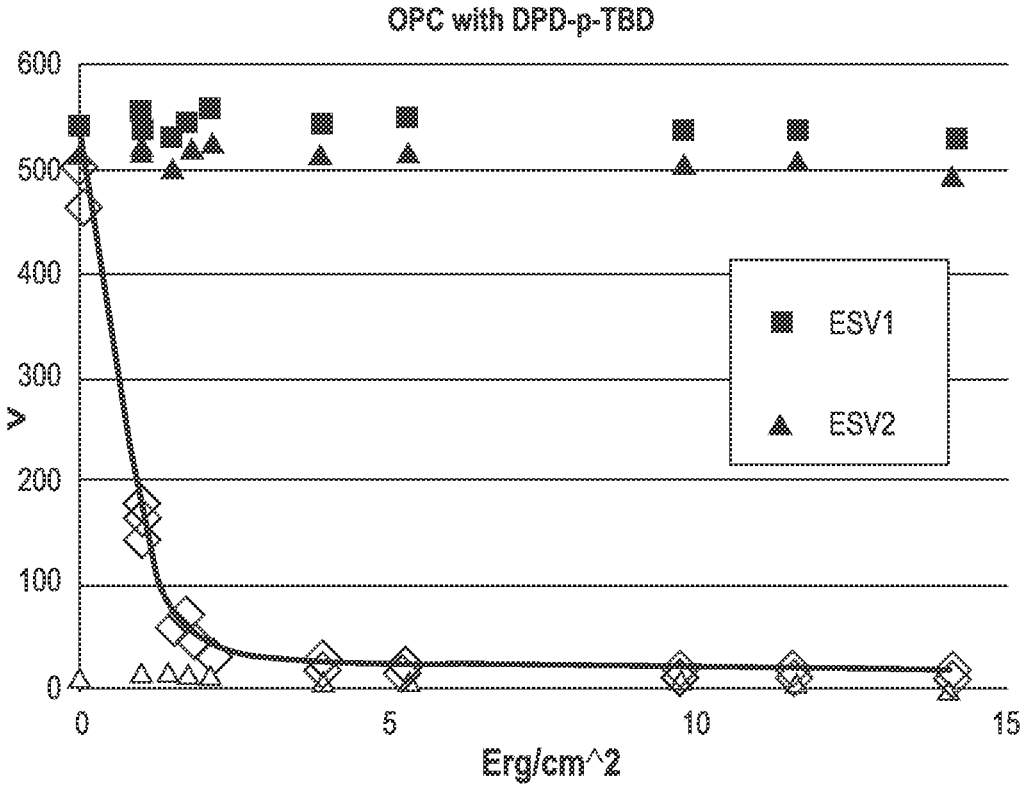
FIG. 5 is a PIDC of a of an example of an embodiment of a photoreceptor containing N4,N4'-bis(4-((E)-4,4-diphenylbuta-1,3-dien-1-yl)phenyl)-N4,N4'-di-p-tolyl-[1,1'-biphenyl]-4,4'-diamine.

A photo-induced discharge curve (PIDC) for DPD-p-TBD in a typical AMAT formulation and OPC formulation compared to conventional m-TBD in a typical AMAT formulation are shown in FIGS. 3, 4 and 5.

In the devices containing N4,N4'-bis(4-((E)-4,4-diphenylbuta-1,3-dien-1-yl)phenyl)-N4,N4'-di-p-tolyl-[1,1'-biphenyl]-4,4'-diamine in the CTL (Examples 2 and 3), the residual voltage was determined to be 10V. In the control device with m-TBD the residual voltage was determined to be 45V. This is a significant improvement in the post-discharge voltage. The results are even better than TM-TBD which has shown to have a benchmark post-discharge voltage.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A photoconductor comprising:

a substrate;

a charge generating layer;

a charge transport layer comprising N4,N4'-bis(4-((E)-4,4-diphenylbuta-1,3-dien-1-yl)phenyl)-N4,N4'-di-p-tolyl-[1,1'-biphenyl]-4,4'-diamine and a tetraaryl polycarbonate copolymer binder wherein the N4,N4'-bis(4-((E)-4,4-diphenylbuta-1,3-dien-1-yl)phenyl)-N4,N4'-di-p-tolyl-[1,1'-biphenyl]-4,4'-diamine comprises a weight percent of the charge transport layer of from about 50 to about 70 wherein the tetraaryl polycarbonate copolymer binder is selected from a group consisting of:

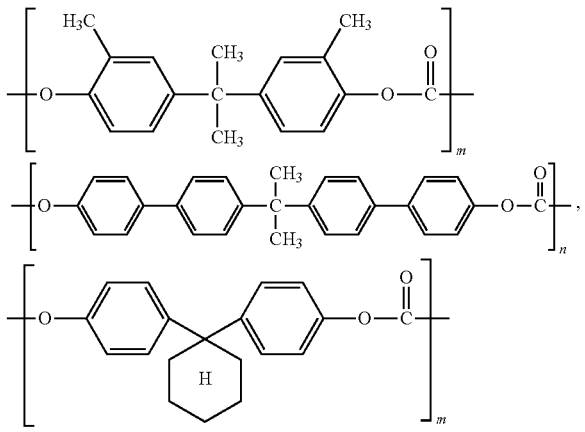

-continued

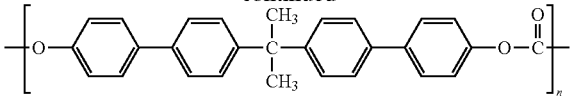

and

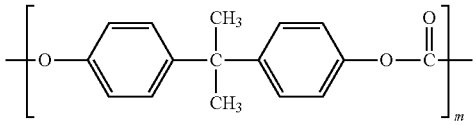

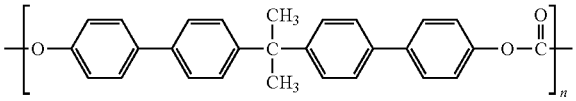

wherein the ratio of n/m is from about 40/60 to about 10/90.

2. The photoconductor of claim 1, further comprising an overcoat layer in contact with and contiguous to said charge transport layer.

3. The photoconductor of claim 2, wherein the overcoat layer comprises a material selected from the group consisting of thermosetting resins, UV resins, e-beam cured resins, polyethylene-block-polyethylene glycol copolymers, melamine resins, and structured organic films.

4. The photoconductor of claim 2, wherein the overcoat layer has a thickness of from about 1 micrometer to about 25 micrometers.

5. The photoconductor of claim 1, wherein said charge generating layer is comprised of a photogenerating component, and a polymer binder.

6. The photoconductor of claim 5, wherein said photogenerating component is selected from the group consisting of: a metal phthalocyanine, a metal free phthalocyanine, a titanyl phthalocyanine, a halogallium phthalocyanine, a hydroxygallium phthalocyanine, and a perylene.

7. A photoconductor comprising: a substrate, a charge generating layer, and at least one charge transport layer comprising N4,N4'-bis(4-((E)-4,4-diphenylbuta-1,3-dien-1-yl)phenyl)-N4,N4'-di-p-tolyl-[1,1'-biphenyl]-4,4'-diamine and a tetraaryl polycarbonate copolymer binder wherein the N4,N4'-bis(4-((E)-4,4-diphenylbuta-1,3-dien-1-yl)phenyl)-N4,N4'-di-p-tolyl-[1,1'-biphenyl]-4,4'-diamine comprises a weight percent of the charge transport layer of from about 50 to about 70, wherein the tetraaryl polycarbonate copolymer binder is selected from a group consisting of:

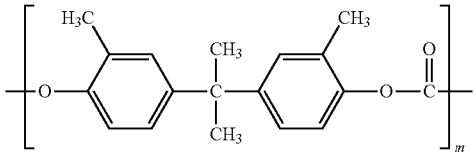

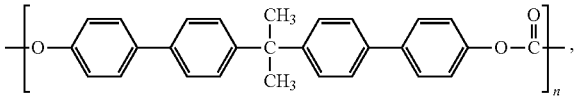

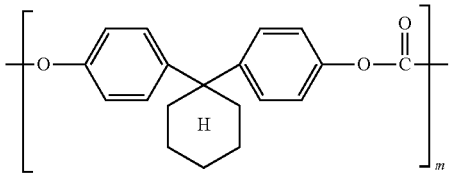

-continued

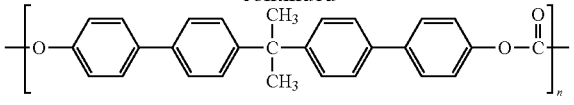

and

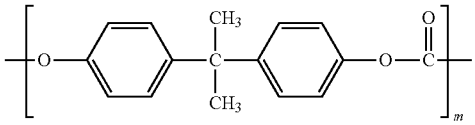

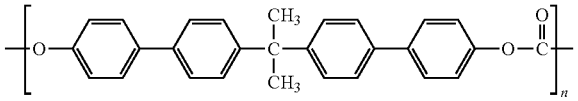

wherein the ratio of n/m is from about 40/60 to about 10/90, and an overcoat layer in contact with and contiguous to said charge transport layer, the overcoat layer comprising a structured organic film (SOF).

8. The photoconductor in accordance with claim 7, wherein the charge generating layer includes a photogenerating pigment selected from the group consisting of: metal phthalocyanine, metal free phthalocyanine, a titanyl phthalocyanine, a halogallium phthalocyanine, a hydroxygallium phthalocyanine, a perylene, or mixtures thereof.

9. A photoconductor comprising a substrate, a photogenerating layer, a charge transport layer comprising [N4,N4'-bis(4-((E)-4,4-diphenylbuta-1,3-dien-1-yl)phenyl)-N4,N4'-di-p-tolyl-[1,1'-biphenyl]-4,4'-diamine] dispersed in a tetraaryl polycarbonate copolymer binder wherein the N4,N4'-bis(4-((E)-4,4-diphenylbuta-1,3-dien-1-yl)phenyl)-N4,N4'-di-p-tolyl-[1,1'-biphenyl]-4,4'-diamine comprises a weight percent of the charge transport layer of from about 50 to about 70, wherein the tetraaryl polycarbonate copolymer binder is selected from a group consisting of:

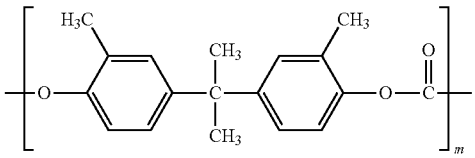

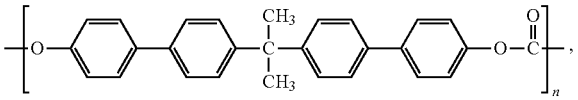

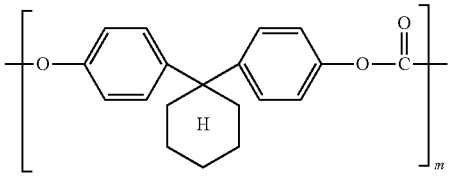

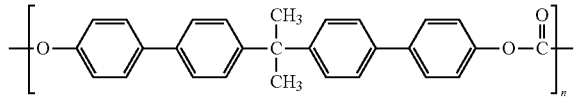

and

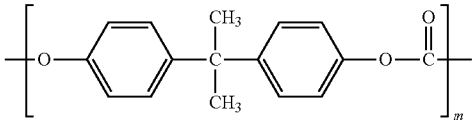

-continued

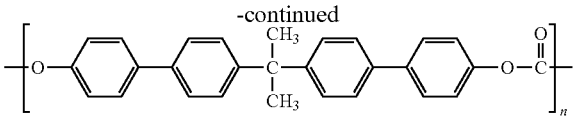

wherein the ratio of n/m is from about 40/60 to about 10/90.

10. The photoconductor in accordance with claim 9 wherein the charge transport layer further comprises biphenyl type of polycarbonate copolymers selected from the group consisting of:

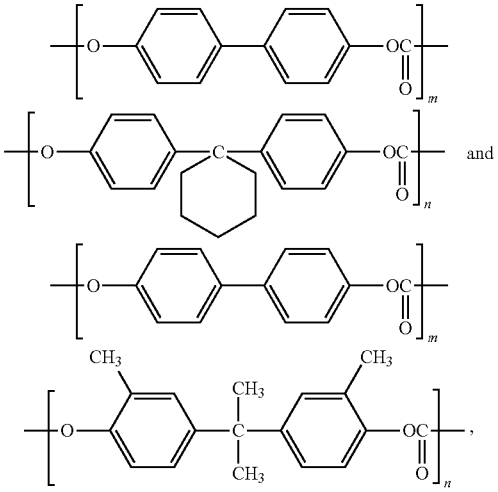

wherein the ratio of m/n is from about 40/60 to about 10/90.

11. The photoconductor in accordance with claim 9, wherein said photogenerating layer is comprised of a photogenerating component and a polymer binder.

12. The photoconductor in accordance with claim 11, wherein polymer binder is selected from the group consisting of: polycarbonates, acrylate polymers, methacrylate polymers, vinyl polymers, cellulose polymers, polyesters, polysiloxanes, polyamides, polyurethanes, epoxies and polyvinylacetals.

13. The photoconductor in accordance with claim 9, wherein the charge transport layer further comprises a material selected from the group consisting of: N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, and mixtures thereof.

14. The photoconductor in accordance with claim 9, wherein said photogenerating layer is comprised of at least one of a metal phthalocyanine, metal free phthalocyanine, a titanyl phthalocyanine, a halogallium phthalocyanine, a hydroxygallium phthalocyanine, a perylene derivative, or mixtures thereof.

15. A photoconductor in accordance with claim 9, further comprising an overcoat.

16. A xerographic apparatus comprising:

an imaging member including a substrate, a photogenerating layer, a charge transport layer comprising [N4,N4'-bis(4-((E)-4,4-diphenylbuta-1,3-dien-1-yl)phenyl)-N4,N4'-di-p-tolyl-[1,1'-biphenyl]-4,4'-diamine] dispersed in a tetraryl polycarbonate binder wherein the N4,N4'-bis(4-((E)-4,4-diphenylbuta-1,3-dien-1-yl)phenyl)-N4,N4'-di-p-tolyl-[1,1'-biphenyl]-4,4'-diamine comprises a weight percent of the charge transport layer of from about 50 to about 70, wherein the tetraaryl polycarbonate copolymer binder is selected from a group consisting of:

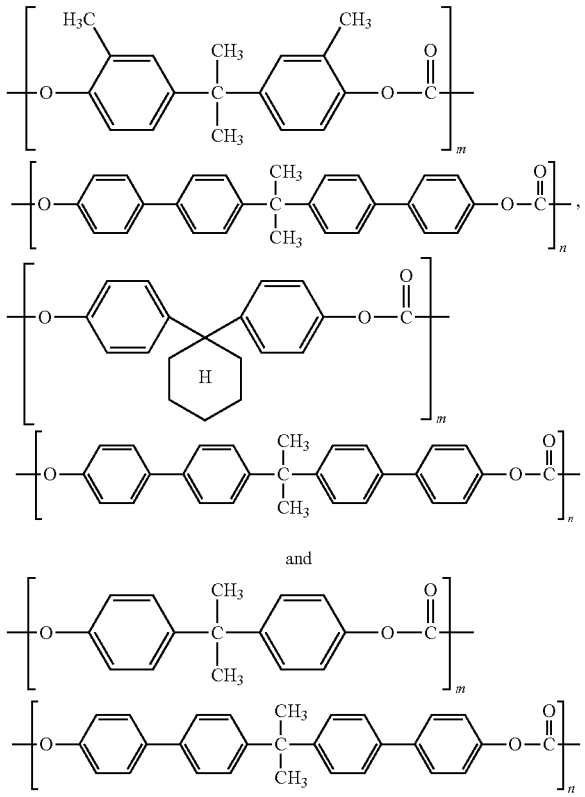

wherein the ratio of n/m is from about 40/60 to about 10/90;

a charging unit to impart electrostatic charge on the imaging member;

an exposure unit to create an electrostatic latent image on the imaging member; and an image material delivery unit to create an image on the imaging member.

17. The xerographic apparatus in accordance with claim 16, wherein the image member further comprises an overcoat.

* * * * *